US006840299B2

(12) United States Patent
Allen et al.

(10) Patent No.: US 6,840,299 B2
(45) Date of Patent: Jan. 11, 2005

(54) CARPET REMOVAL SYSTEM

(76) Inventors: John D. Allen, 323 N. 4th St., Breckenridge, MN (US) 56520; Keith S. Allen, P.O. Box 26, Christine, ND (US) 58015

( * ) Notice: Subject to any disclaimer, the term of this patent is extended or adjusted under 35 U.S.C. 154(b) by 0 days.

(21) Appl. No.: 10/339,975

(22) Filed: Jan. 10, 2003

(65) Prior Publication Data

US 2004/0134625 A1 Jul. 15, 2004

(51) Int. Cl.[7] ..... B32B 35/00

(52) U.S. Cl. ..... 156/584; 156/344; 254/209; 254/211; 254/227

(58) Field of Search ..... 254/199, 200, 254/202, 203, 208, 209, 210, 211, 213, 219, 227, 242, 262; 294/8.6, 103.1, 104, 119.1, 902; 269/53, 54.5; 16/5; 156/344, 584

(56) References Cited

U.S. PATENT DOCUMENTS

| | | | | | |
|---|---|---|---|---|---|
| 5,505,433 | A | * | 4/1996 | Carmichael et al. | 254/211 |
| 5,909,868 | A | * | 6/1999 | Galella | 254/211 |
| 6,613,188 | B1 | * | 9/2003 | Berg et al. | 156/344 |
| 2004/0026045 | A1 | * | 2/2004 | Adleman | 156/584 |

* cited by examiner

*Primary Examiner*—Mark A. Osele

(57) ABSTRACT

A carpet removal system for efficiently removing carpet from a floor. The carpet removal system includes a leverage member, an engaging member for engaging the carpet to be removed, and a connecting member connected between the leverage member and the engaging member. The leverage member is an elongate structure which allows for the connecting member to be attached at various locations for providing various leverage forces. The leverage member includes a footplate having a plurality of engaging teeth for engaging the flooring.

8 Claims, 5 Drawing Sheets

CARPET REMOVAL SYSTEM

DESCRIPTION OF THE RELATED ART

Carpet removal devices have been in use for years. Conventional carpet removal devices are large motor operated devices that are generally suitable for large carpet removal projects.

Often times on small carpet removal projects the carpet remover will usually attempt to remove the carpet by lifting upon the carpet directly which is physically demanding and can cause injuries. In addition, conventional carpet removal devices are large, bulky and expensive for many smaller operations.

While these devices may be suitable for the particular purpose to which they address, they are not as suitable for efficiently removing carpet from a floor. Conventional carpet removal devices are large and expensive to utilize.

In these respects, the carpet removal system according to the present invention substantially departs from the conventional concepts and designs of the prior art, and in so doing provides an apparatus primarily developed for the purpose of efficiently removing carpet from a floor.

BRIEF SUMMARY OF THE INVENTION

In view of the foregoing disadvantages inherent in the known types of carpet removal devices now present in the prior art, the present invention provides a new carpet removal system construction wherein the same can be utilized for efficiently removing carpet from a floor.

The general purpose of the present invention, which will be described subsequently in greater detail, is to provide a new carpet removal system that has many of the advantages of the carpet removal devices mentioned heretofore and many novel features that result in a new carpet removal system which is not anticipated, rendered obvious, suggested, or even implied by any of the prior art carpet removal devices, either alone or in any combination thereof.

To attain this, the present invention generally comprises a leverage member, an engaging member for engaging the carpet to be removed, and a connecting member connected between the leverage member and the engaging member. The leverage member is an elongate structure which allows for the connecting member to be attached at various locations for providing various leverage forces. The leverage member includes a footplate having a plurality of engaging teeth for engaging the flooring.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a carpet removal system that will overcome the shortcomings of the prior art devices.

A second object is to provide a carpet removal system for efficiently removing carpet from a floor.

Another object is to provide a carpet removal system that may be utilized upon smaller carpet removal projects.

An additional object is to provide a carpet removal system that is less expensive than conventional carpet removal devices.

A further object is to provide a carpet removal system that decreases the likelihood of physical injury to workers.

Another object is to provide a carpet removal system that is lightweight, small in size and portable.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
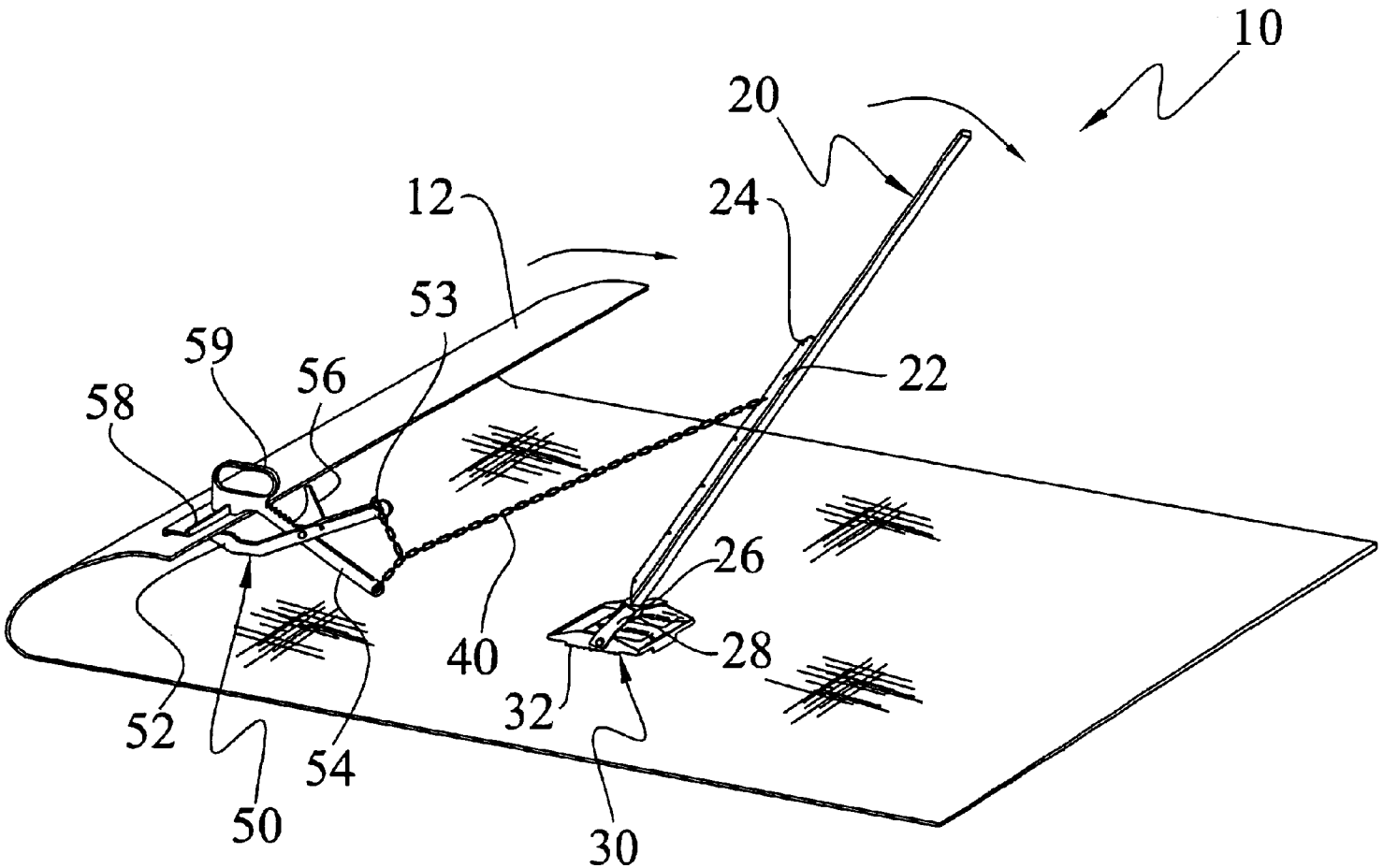
FIG. 1 is an upper perspective view of the present invention attached to carpet and removing the carpet.

Turning now descriptively to the drawings, in which similar reference characters denote similar elements throughout the several views, FIGS. 1 through 5 illustrate a carpet removal system 10, which comprises a leverage member 20, an engaging member 50 for engaging the carpet 12 to be removed, and a connecting member 40 connected between the leverage member 20 and the engaging member 50. The leverage member 20 is an elongate structure which allows for the connecting member 40 to be attached at various locations for providing various leverage forces. The leverage member 20 includes a footplate 30 having a plurality of engaging teeth 32 for engaging the flooring.

B. Engaging Member

Figure 3:
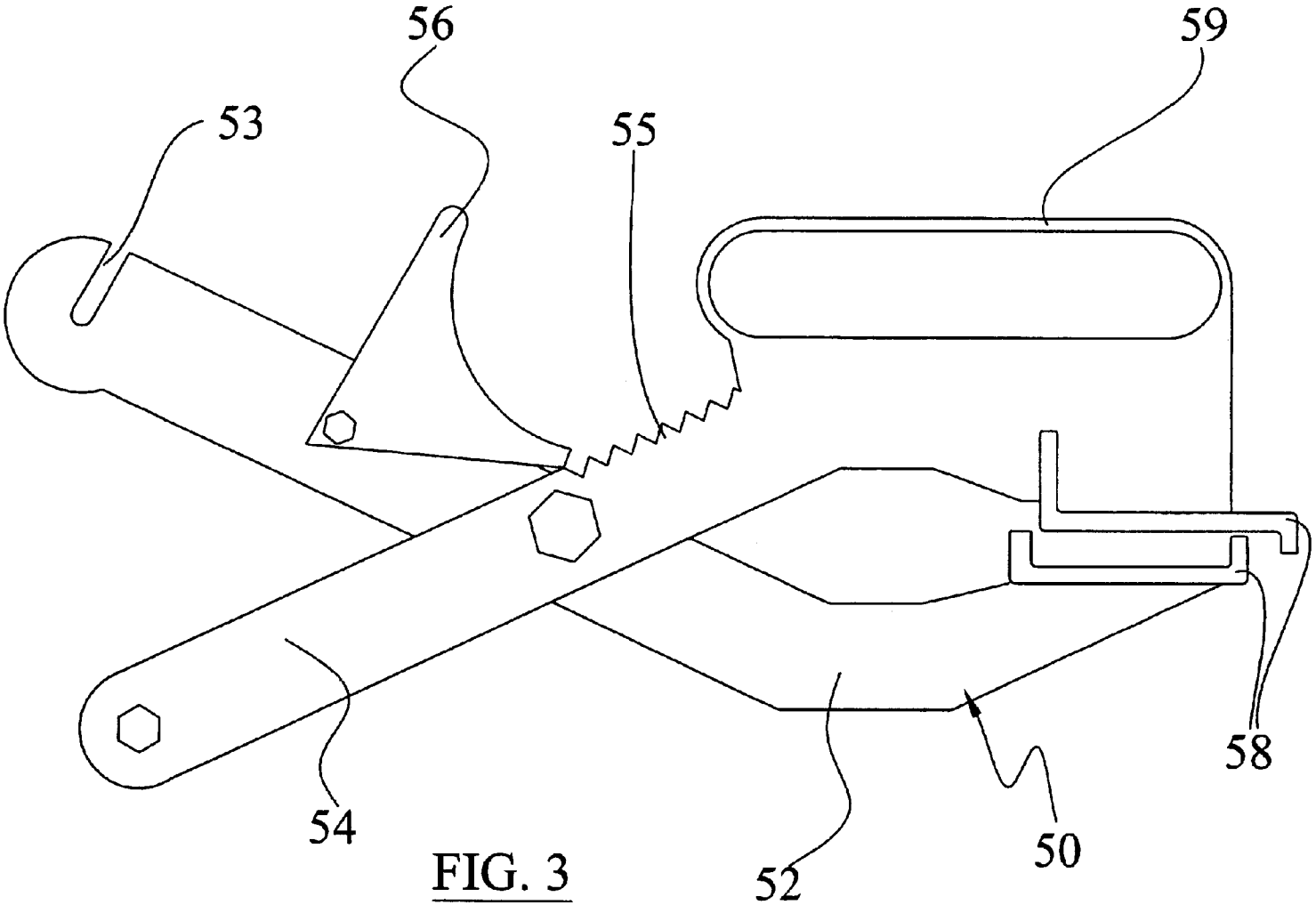
FIG. 3 is a side view of the engagement member.
Figure 4:
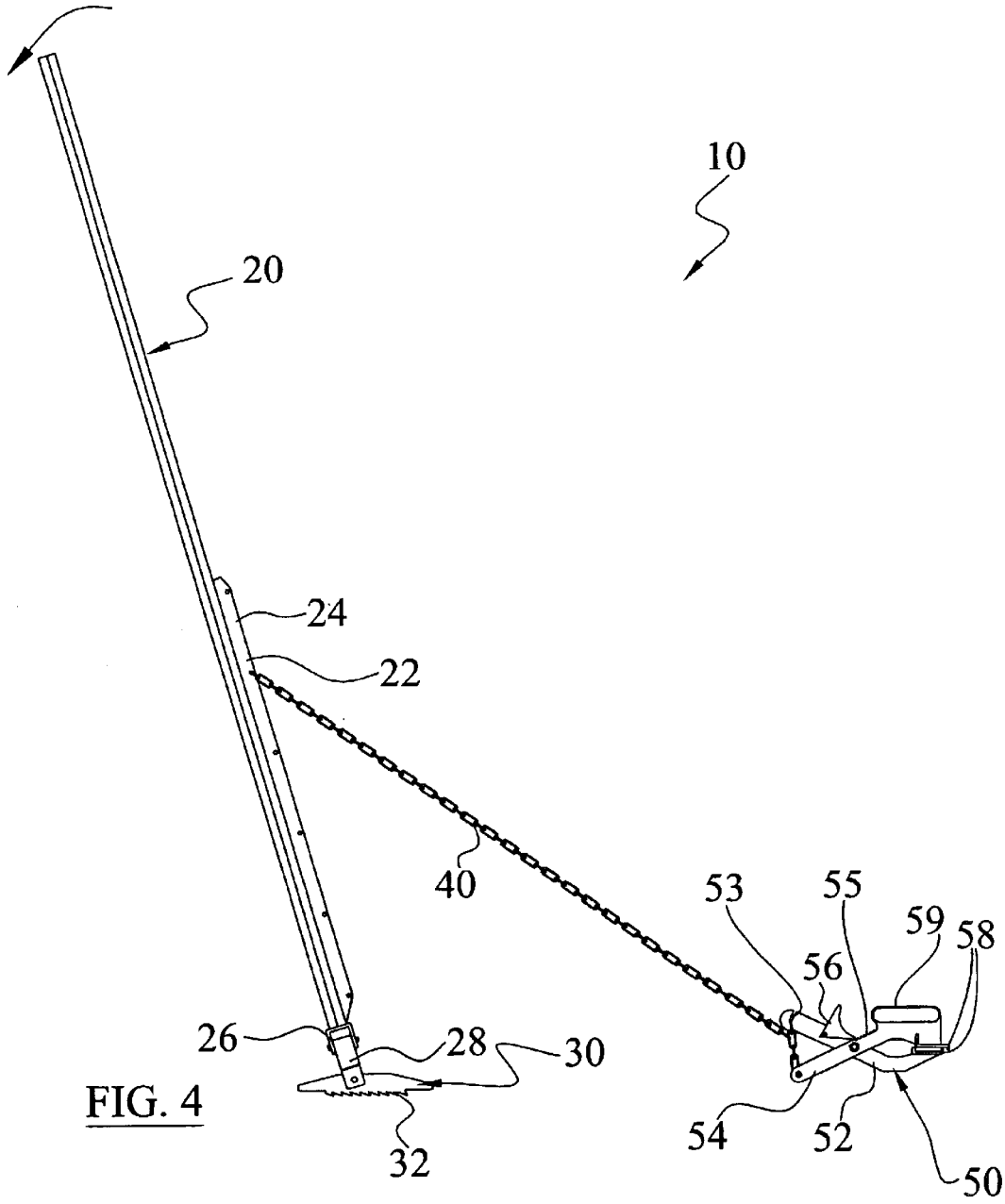
FIG. 4 is a side view of the leverage member and engagement member.

As shown in FIGS. 1, 3 and 4 of the drawings, the engaging member 50 may be comprised of various well-known structures for engaging carpet 12. Engaging members have been utilized for years with conventional removal devices which are motorized which are suitable for usage upon the present invention. The attached drawings illustrating the engaging member 50 should not limit the disclosure of the present invention as various other structures may be utilized that are suitable for attaching to carpet 12.

As best shown in FIG. 3 of the drawings, the engaging member 50 preferably has a first arm 52 and a second arm 54 pivotally attached to one another. The first arm 52 and the second arm 54 each have opposing handle portions and opposing jaws 58. The jaws 58 are formed for catchably retaining the carpet 12 between thereof.

A plurality of catch teeth 55 preferably extend from the second arm 54 that catchably receive a catch member 56 to prevent the jaws 58 from opening. A handle member 59 is attached to the second arm 54 for allowing manipulation of the engaging member 50. The connecting member 40 is attached to the first arm 52 and to the second arm 54. The second arm 54 preferably has a slot 53 for selectively receiving the connecting member 40 at various positions.

The connecting member 40 is preferably comprised of a length of chain. However, various other elongate and flexible structures such as but not limited to cable, rope and the like.

C. Leverage Member

Figure 2:
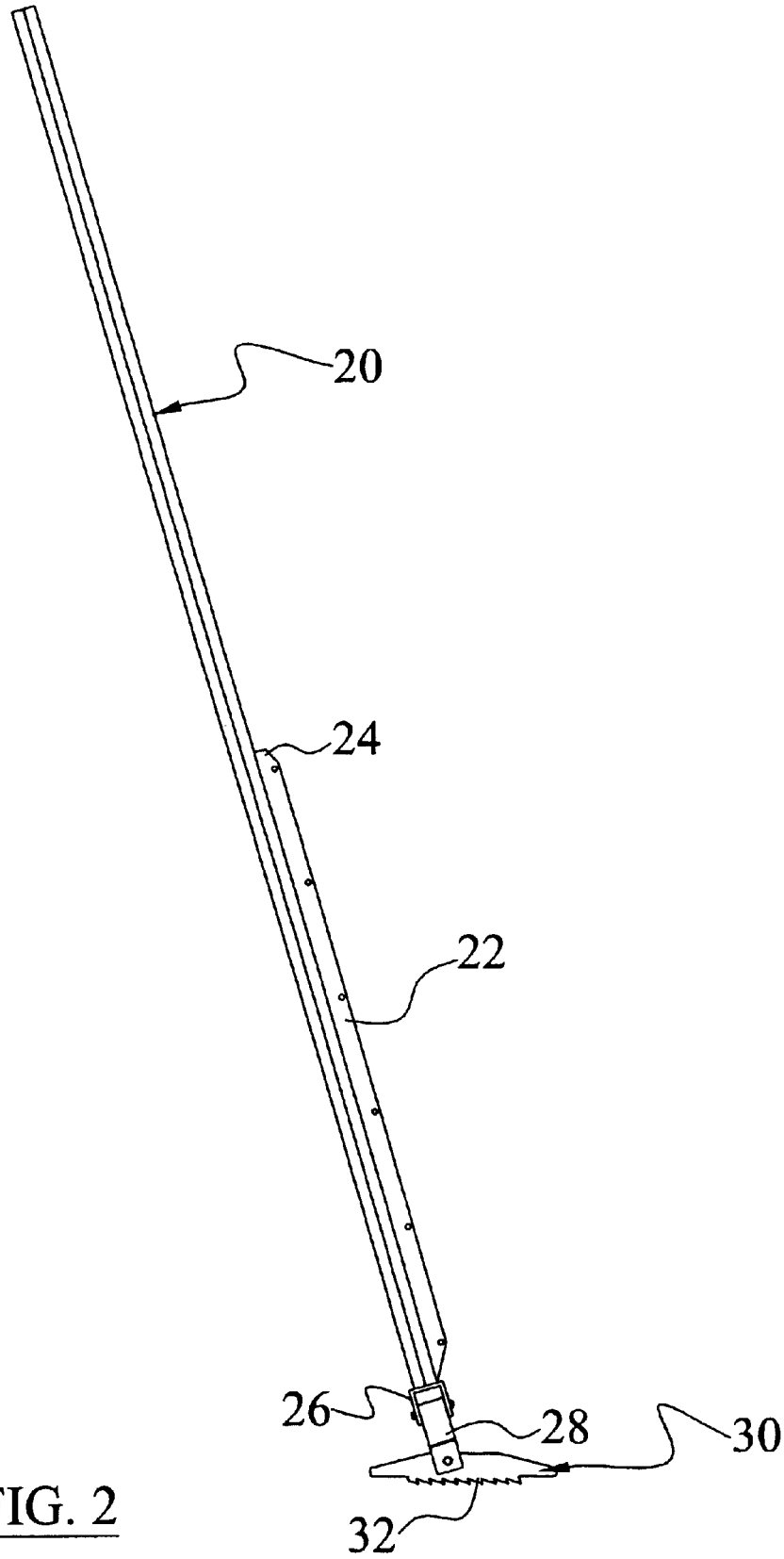
FIG. 2 is a side view of the leverage member.

The leverage member 20 is an elongate structure as best illustrated in FIGS. 1, 2 and 4 of the drawings. The leverage member 20 may be comprised of a solid or tubular structure. The leverage member 20 preferably has a length greater than 4 feet to provide a desirable position for the user.

An extended portion 22 extends from a front portion of the leverage member 20 and has a plurality of receiver apertures 24 as shown in FIGS. 2 and 4 of the drawings. The connecting member 40 may be positioned at any of the receiver apertures 24 by a conventional coupler such as but not limited to a hook member. The receiver apertures 24 are preferably distally spaced for providing various leverage positions.

The lower end of the leverage member 20 has an end coupler 26 for pivotally connecting to a footplate 30. The end coupler 26 may be comprised of various structures and configurations capable of pivoting with respect to the footplate 30 such as a hinge structure. FIGS. 1, 2 and 4 of the drawings illustrate the end coupler 26 having an open structure positioned about a cross member 28 of the footplate 30.

Figure 5:
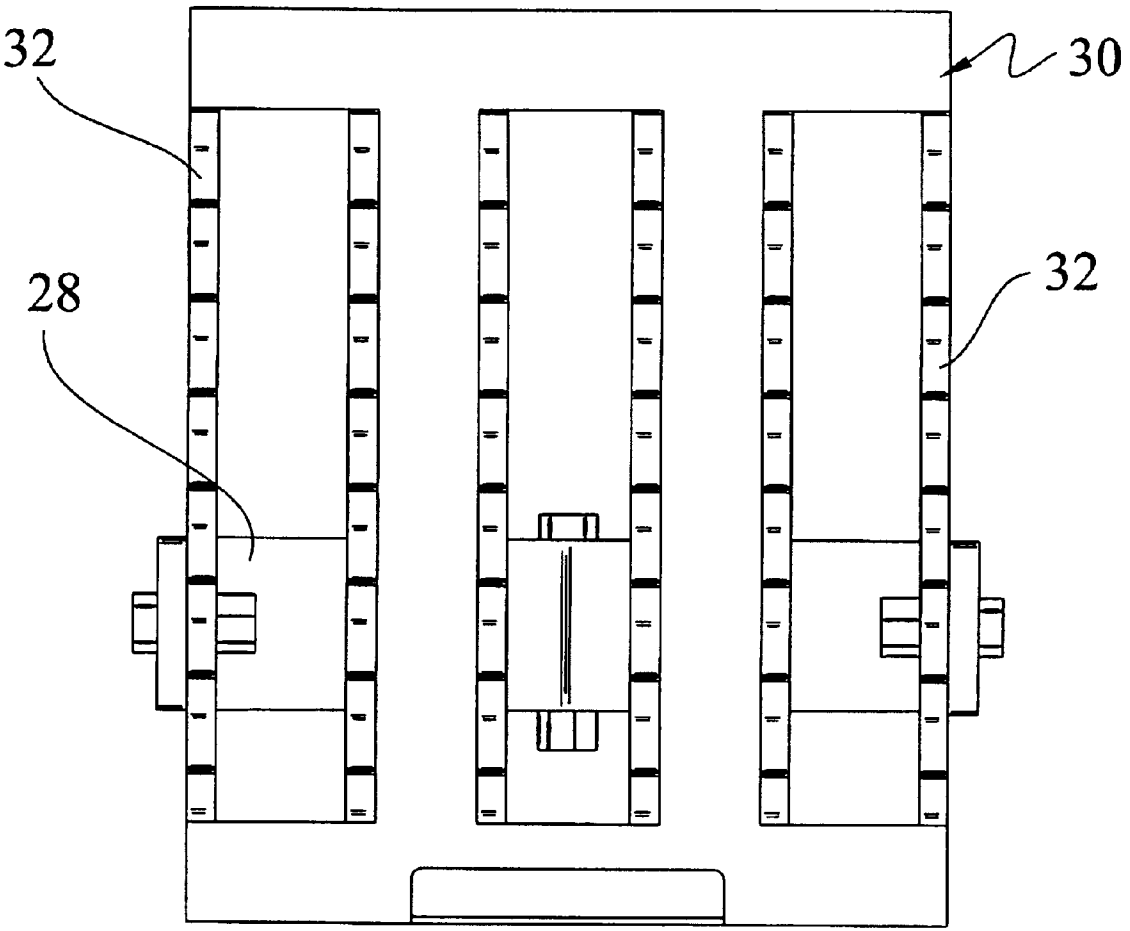
FIG. 5 is a bottom view of the leverage member illustrating the teeth.

The footplate 30 is comprised of a generally flat structure that is pivotally connected to the leverage member 20. The footplate 30 has a plurality of engaging teeth 32 for engaging the carpet 12 or other floor surface to temporarily anchor the leverage member 20. The engaging teeth 32 are preferably angled toward the engaging member 50 as shown in FIG. 4 of the drawings. The engaging teeth 32 are preferably aligned in a plurality of rows as shown in FIG. 5 of the drawings. Various other configurations may be utilized to align the engaging teeth 32.

D. Operation

In use, the user first manually pulls up a portion of the carpet 12 and attaches the engaging member 50 to the carpet 12 as shown in FIG. 1 of the drawings. The user then attaches the connecting member 40 between the engaging member 50 and the leverage member 20 in the desired leverage position. The footplate 30 is then positioned upon the carpet 12 or other floor surface as shown in FIGS. 1 and 4 of the drawings. The user then pulls upon the upper portion of the leverage member 20 which pivots about the footplate 30. The leverage movement causes the connecting member 40 to draw the engaging member 50 which pulls the carpet 12 upwardly and towards the footplate 30. After the user has fully pivoted the leverage member 20, the user then simply repositions the footplate 30 so that the leverage member 20 is approximately vertical and repeats the pivoting of the leverage member 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A carpet removal system, comprising:

an engaging member for engaging a carpet;

a connecting member attached to said engaging member;

a leverage member attached to said connecting member opposite of said engaging member for applying a leverage force to said engaging member, wherein said leverage member is comprised of an elongate structure;

an extended portion extending along and forwardly from a front portion of said leverage member, wherein said extended portion includes a plurality of receiver apertures for receiving said connecting member;

a footplate having a front portion and a rear portion;

a plurality of engaging teeth extending from a lower surface of said footplate;

a cross member pivotally attached to said rear portion of said footplate, wherein said cross member pivots about a first axis that is substantially perpendicular with respect to a longitudinal axis extending between said front portion and said rear portion; and an end coupler attached to a lower end of said leverage member and pivotally attached to said cross member, wherein said end coupler pivots about a second axis that is substantially parallel with respect to said longitudinal axis.

2. The carpet removal system of claim 1, wherein said receiver apertures are distally spaced apart for providing various leverage forces.

3. The carpet removal system of claim 1, wherein said connecting member is comprised of a chain.

4. The carpet removal system of claim 1, wherein said connecting member is comprised of a cable.

5. The carpet removal system of claim 1, wherein said connecting member is comprised of a rope.

6. The carpet removal system of claim 1, wherein said connecting member is comprised of an elongate flexible member.

7. The carpet removal system of claim 1, wherein said connecting member is attached to said leverage member by a coupler member.

8. The carpet removal system of claim 1, wherein said end coupler is comprised of a tubular structure.

* * * * *